US005943895A

United States Patent [19]

Lemper

[11] Patent Number: 5,943,895

[45] Date of Patent: Aug. 31, 1999

[54] DYNAMIC CROWN CONTROL BACK-UP ROLL ASSEMBLY

[75] Inventor: Herbert Lemper, McMurray, Pa.

[73] Assignee: SMS Schloemann-Siemag Aktiengesellschaft, Dusseldorf, Germany

[21] Appl. No.: 08/991,682

[22] Filed: Dec. 16, 1997

Related U.S. Application Data

[60] Provisional application No. 60/044,233, Apr. 24, 1997.

[51] Int. Cl.[6] ..... B21B 29/00

[52] U.S. Cl. ..... 72/241.4; 72/252.5; 72/366.2

[58] Field of Search ..... 100/162 B; 72/8.9, 72/9.1, 11.6, 11.7, 12.8, 241.2, 241.4, 241.6, 241.8, 242.2, 242.4, 252.5, 366.2

[56] References Cited

U.S. PATENT DOCUMENTS

| | | | |
|---|---|---|---|
| 1,864,299 | 6/1932 | Fawell . | |
| 1,910,158 | 5/1933 | Frank . | |
| 2,010,211 | 8/1935 | Wood . | |
| 3,604,086 | 9/1971 | Bretschneider | 29/113 |
| 3,879,827 | 4/1975 | Lehmann | 29/116 AD |
| 3,949,455 | 4/1976 | Biondetti | 29/116 AD |
| 4,059,976 | 11/1977 | Christ et al. | 72/19 |
| 4,062,096 | 12/1977 | Eibe | 29/113 AD |
| 4,156,359 | 5/1979 | Verbickas | 72/243 |
| 4,242,781 | 1/1981 | Takigawa et al. | 29/113 |
| 4,407,151 | 10/1983 | Gronbech | 72/241 |
| 4,414,889 | 11/1983 | Güttinger | 100/162 B |
| 4,583,273 | 4/1986 | Schnyder et al. | 29/113 AD |
| 4,596,130 | 6/1986 | Yoshii et al. | 72/241 |
| 4,599,770 | 7/1986 | Kato et al. | 72/241.4 |
| 4,676,085 | 6/1987 | Ellis | 72/20 |
| 4,813,258 | 3/1989 | Ginzburg | 72/241 |
| 4,860,416 | 8/1989 | Masui et al. | 29/116.2 |
| 4,875,261 | 10/1989 | Nishida | 29/116.1 |
| 4,882,922 | 11/1989 | Dominique | 72/243 |
| 4,912,956 | 4/1990 | Matricon et al. | 72/243 |
| 5,007,152 | 4/1991 | Tomizawa et al. | 29/116.2 |
| 5,093,974 | 3/1992 | Ginzburg | 29/113.2 |
| 5,347,837 | 9/1994 | Ginzburg | 72/243.6 |
| 5,471,859 | 12/1995 | Sendzimir et al. | 72/241.4 |
| 5,483,812 | 1/1996 | Dempsey | 72/252.5 |

FOREIGN PATENT DOCUMENTS

| | | | |
|---|---|---|---|
| 584642 | 8/1992 | European Pat. Off. . | |
| 584642 | 3/1994 | European Pat. Off. | 72/241.4 |
| 61-7003 | 1/1986 | Japan . | |
| 61-276704 | 6/1986 | Japan . | |
| 1-18512 | 1/1989 | Japan | 72/241.4 |
| 3-138006 | 6/1991 | Japan | 72/241.4 |
| 6-39409 | 2/1994 | Japan | 72/241.4 |
| 6-154808 | 6/1994 | Japan | 72/241.4 |
| 6-154818 | 6/1994 | Japan | 72/241.4 |
| 2238597 | 6/1991 | United Kingdom | 72/241.4 |

*Primary Examiner*—Joseph J. Hail, III
*Assistant Examiner*—Ed Tolan
*Attorney, Agent, or Firm*—Friedrich Kueffner

[57] ABSTRACT

The crown on a steel strip in a rolling mill is controlled by a continuous rotational adjustment of an arbor in response to a control signal representing the current crown profile or deviation therefrom, the arbor being equipped with a series of eccentric rings fixed thereto, bearings surrounding the rings, and a continuous or segmented sleeve around the rings. Where the sleeve is segmented, use of an intermediate roll is suggested.

19 Claims, 5 Drawing Sheets

1
2
3
4
5
6
7
8
9
21
22
43
1b
1c
1d
1e 2b
2c
2d
2e
1
7
8
9
10
11
12
13
14
22
43

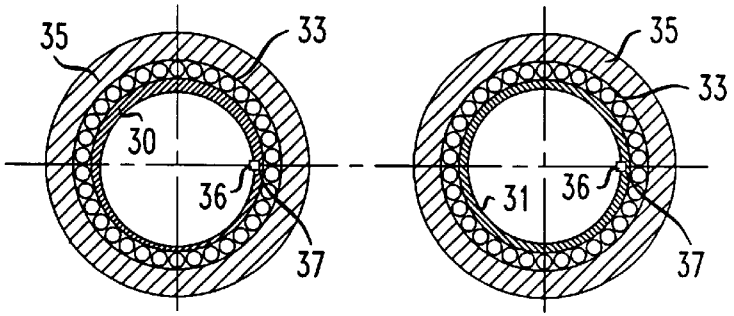
FIG. 3B
FIG. 3C
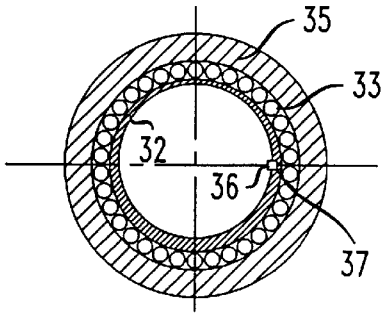
FIG. 3D
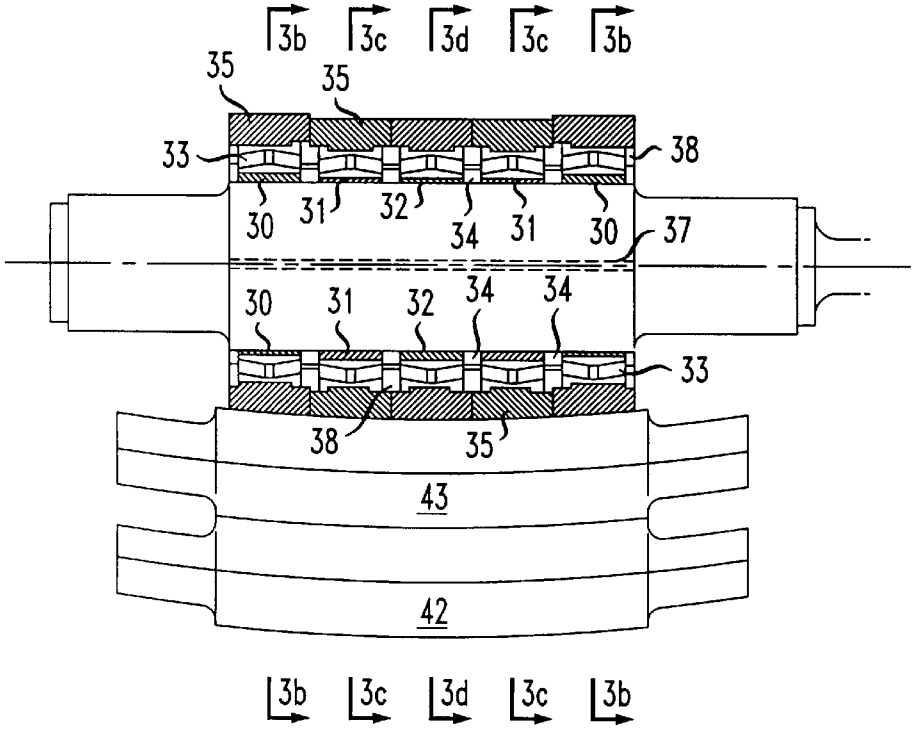
FIG. 3A

DYNAMIC CROWN CONTROL BACK-UP ROLL ASSEMBLY

RELATED APPLICATIONS

This application claims the benefit of Provisional Application Ser. No. 60/044,233 filed Apr. 24, 1997 in the name of the inventor herein, Herbert Lemper.

TECHNICAL FIELD

This invention relates to rolling mills and particularly to methods and apparatus for crown control.

BACKGROUND OF THE INVENTION

Much of the effort of the art in the past in crown control has been directed to bending the work rolls or backup rolls to exert pressure on the center of the work surface. Bending of large rolls operating at high speed is difficult and requires massive machinery. Arbors and bendable rolls may be equipped with a sleeve as disclosed by Ginzburg in U.S. Pat. Nos. 4,813,258, 5,093,974 and 5,347,837. An early sleeve on a mandrel is shown by Fawell in U.S. Pat. No. 1,864,299. Frank, in U.S. Pat. No. 1,919,158, also shows an early "rigid beam" having a "heavy shell" and bearings between and around the beam; see also Wood U.S. Pat. No. 2,010,211. Various hydraulic systems have been used to flex a sleeve, either directly or indirectly, mounted on an arbor or other type of back-up device—see Bretschneider, U.S. Pat. No. 3,604,086, Lehman U.S. Pat. No. 3,879,827, Takigawa et al U.S. Pat. No. 4,242,781, Eibe U.S. Pat. No. 4,062,096, Biondetti U.S. Pat. No. 3,949,455, and Christ U.S. Pat. No. 4,059,976 (see FIG. 3 particularly).

Others have developed more direct mechanical methods of reinforcing the center of the work roll. See Gronbeck's hollow back-up roll which may be supported by discs (U.S. Pat. No. 4,407,151), the variable shaped back-up roll of Yoshii et al in U.S. Pat. No. 4,596,130, the variably controlled thrust load application devices of Matricon et al in U.S. Pat. No. 4,912,956 and Dominique in U.S. Pat. No. 4,882,922, and the fixed supports Guettinger describes in U.S. Pat. No. 4,414,889. Schnyder's hydrostatic support elements have bearing surfaces on inner traveling ring surfaces "deformed into a slightly elliptical shape"—col. 4, line 67. Ellis, in U.S. Pat. No. 4,676,085, controls the positions of hydraulic piston cylinder assemblies which act on an intermediate roll 24.

In U.S. Pat. No. 4,875,261, Nishida discusses prior art in which a back-up roll is equipped with cylindrical rollers between the roll shaft and an outer casing. He adds tapered roller bearings between the cylindrical rollers and an outer casing to receive a thrust load from the cylindrical rollers.

Negative and positive crowns are created by Verbickas according to U.S. Pat. No. 4,156,359, which shows eccentric cluster rolls in FIG. 2. The eccentric cluster rolls may be turned to vary the force on the surface of the working rolls. Masui et al, in U.S. Pat. No. 4,860,416, discloses a "variable crown" configuration employing tapered bearings between an arbor and a sleeve. While the "radial center of the inner peripheral surface of the inner race of each bearing is eccentric with respect to the radial center of outer peripheral surface of the inner race of the same bearing at the ends of the inner races" ('416 col 5 lines 21–25), this condition (see FIG. 16 of '416) is symmetrical around the entire bearing, i.e. there is no eccentricity or variation in the distance from the axis of the arbor to the outside of bearings. Tomizawa et al U.S. Pat. No. 5,007,152 is based on Masui and employs a curved arbor to vary the crown profile.

The art is still searching for a simple crown control system that can be operated using a single back-up roll.

SUMMARY OF THE INVENTION

I have invented a back-Lip roll that will provide dynamic crown control of maximum range, positive or negative, with a minimum application of external force. It requires no hydraulic functions of any kind inside the actual back-up roll. The back-up roll of this invention comprises mill-type components such as mill-type roller bearings and eccentrics.

The back-up roll of this invention is based on an arbor fitted with a plurality of eccentric rings. The arbor is continuously oriented to alter the crown profile in response to a continuous input signal which is a function of the product crown or its deviation from a desired crown set point or other set of conditions. Movement, i.e. the continuous rotational re-orientation of the arbor, may be effected by hydraulic, electric, or other known means for angularly positioning the arbor.

Three variations of my invention are presented herein. In each, an arbor is fitted with a series of eccentric rings. Each eccentric ring is in turn fitted with a bearing around its outer dimension. In two of the variations, a sleeve encloses the entire assembly; the sleeve is able to turn on the bearings by contact with the working roll.

The first variation of my invention employs a clearance between the bearings and the sleeve, and the second employs a clearance between the arbor and the rings. In the third variation, a series of collars is used instead of a sleeve, and an intermediate roll is used to avoid the possibility of generating markings on the strip.

BRIEF DESCRIPTION OF THE DRAWINGS

FIG. 1*a* shows sections of the bearings and rings surrounding an arbor; the bearings and rings are in turn surrounded by a sleeve. FIGS. 1*b*–1*e* show sections through the sets of rings and bearings. Collectively, FIGS. 1*a*–1*e* show the configuration in which the clearance (exaggerated for illustration) is outside the bearings.

In FIGS. 3*a*–3*d*, a variation is shown in which the sleeve is divided into discrete sleeves or collars for each set of rings and bearings.

DETAILED DESCRIPTION OF THE INVENTION

Figures 1A, 1B, 1C, 1D, 1E:
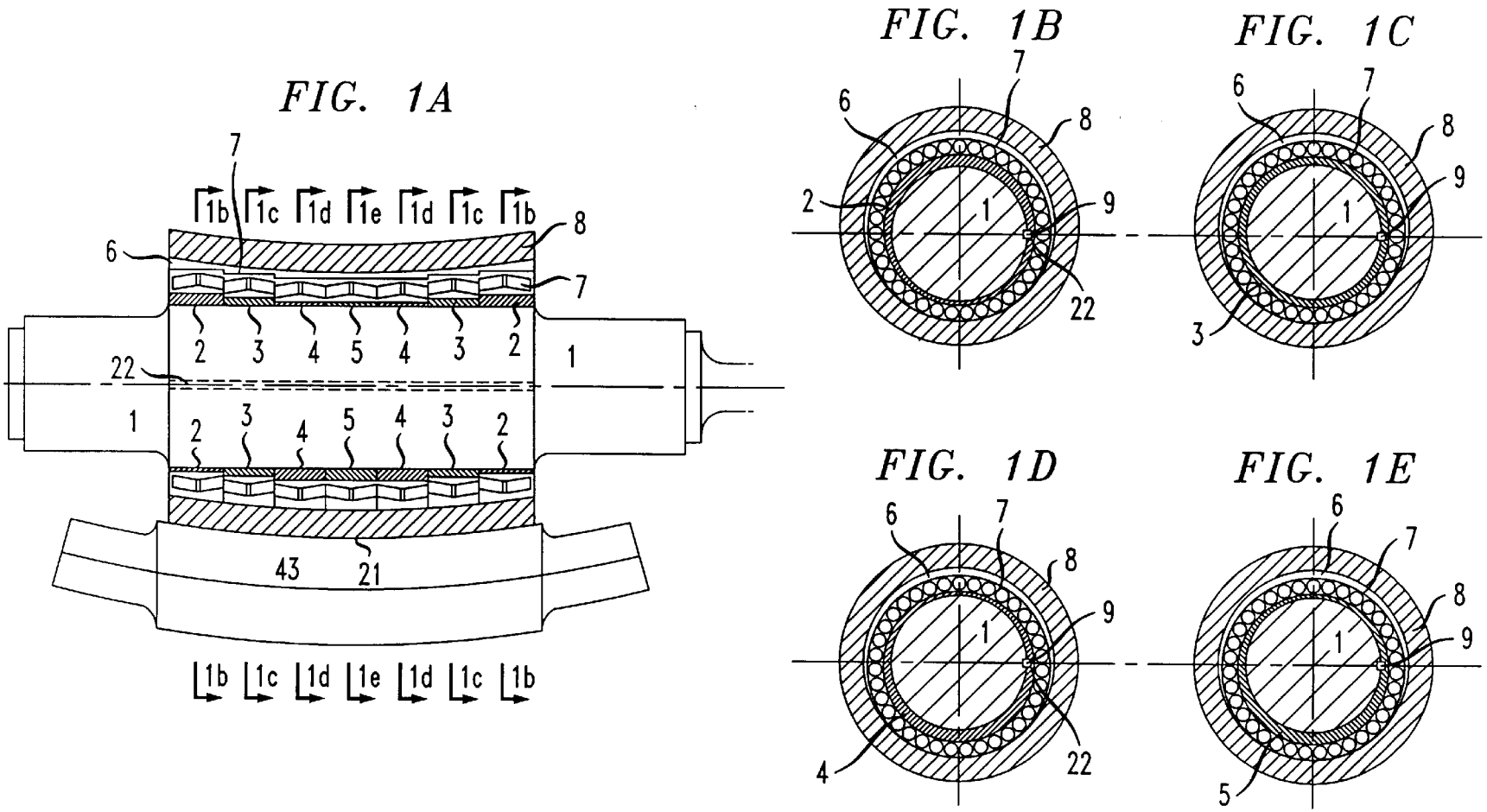
FIGS. 1*a*–1*e* represent a preferred embodiment of my invention.

Referring now to FIGS. 1*a*–1*e*, eccentric rings 2, 3, 4, and 5 are seen to be mounted on arbor 1. In this depiction, only the central ring is designated 5, while two rings each are designated 2, 3, and 4. As seen in FIG. 1*a*, each pair of rings 2, 3, and 4 is mounted to provide a maximum crown position which recedes to the right and left from the central ring 5, while central ring 5 defines the crest 21 of the crown. The dimensions of eccentric rings 2, 3, 4, and 5 are exaggerated in this drawing for illustration, resulting in an exaggerated curvature of sleeve 8 and working roll 43.

By an eccentric ring I mean a ring which has a cylindrical bore and a cylindrical external surface, wherein the cylindrical bore and the cylindrical external surface have spaced parallel axes. The degree of eccentricity will determine the "maximum out" profile desired for the position of the ring on the arbor. The rings 2, 3, 4, and 5 are located and held on the arbor by key 9 in different radial orientations, as will be seen below.

The preferred manner of determining the eccentricity of the rings will be explained with reference to FIG. 5, but it may be said here that it is possible for the center ring to have the same degree of eccentricity as the end rings, as may be the case with the seven-ring configuration of FIGS. 1 and 2.

Around each ring 2, 3, 4, and 5 is a bearing 7, and surrounding all of the bearings 7 is sleeve 8. From FIGS. 1*b*, 1*c*, 1*d*, and 1*e*, it may be seen that while the rings 2, 3, 4, and 5 have circular bores and are externally cylindrical, the bores and external surfaces are based on different parallel axes, so that their thicknesses vary radially. For example, in FIG. 1*b*, ring 2 is seen to have a thick portion at its top and a correspondingly thin wall at its bottom, while ring 5, shown in FIG. 1*e*, is oriented oppositely, having a thin portion at its top and a thick wall at its bottom in the maximum crown position shown. The rings 2, 3, 4, and 5 are held in place relative to one another by a key 9 lodged in slot 22 in each ring and in arbor 1.

Clearance space 6 is shown in exaggerated proportion in FIGS. 1*b*, 1*c*, 1*d*, and 1*e*. In a sleeve 8 having a nominal internal diameter of fifty inches, for example, the clearance space 6 could be no more than 0.02 inch if the maximum crown adjustment is 1000 micrometers, for example, but could vary considerably (plus or minus 50%) with the crown adjustment. The sleeve preferably has a built-in crown (not shown) made by grinding it to provide, for example, a center having a thickness of 500 micrometers greater than the thickness at the ends of the sleeve, the profile between the crown point and the end points being a circular arc (when the sleeve is not distorted by the rings) determined by the three points. The "maximum in" position of rings having a 500 micrometer difference will, therefore, result in a flat profile for the external working surface of the sleeve. The "maximum out" position will be assisted by the extra thickness of the sleeve.

Orientation of arbor 1 and the rings fixed to it—and therefore adjustment of the crown profile—is continuously changed in response to a control signal, sometimes known as a shapemeter signal, which is a function of the current product crown, as will be explained in more detail with reference to FIG. 4.

Figures 2A, 2B, 2C, 2D, 2E:
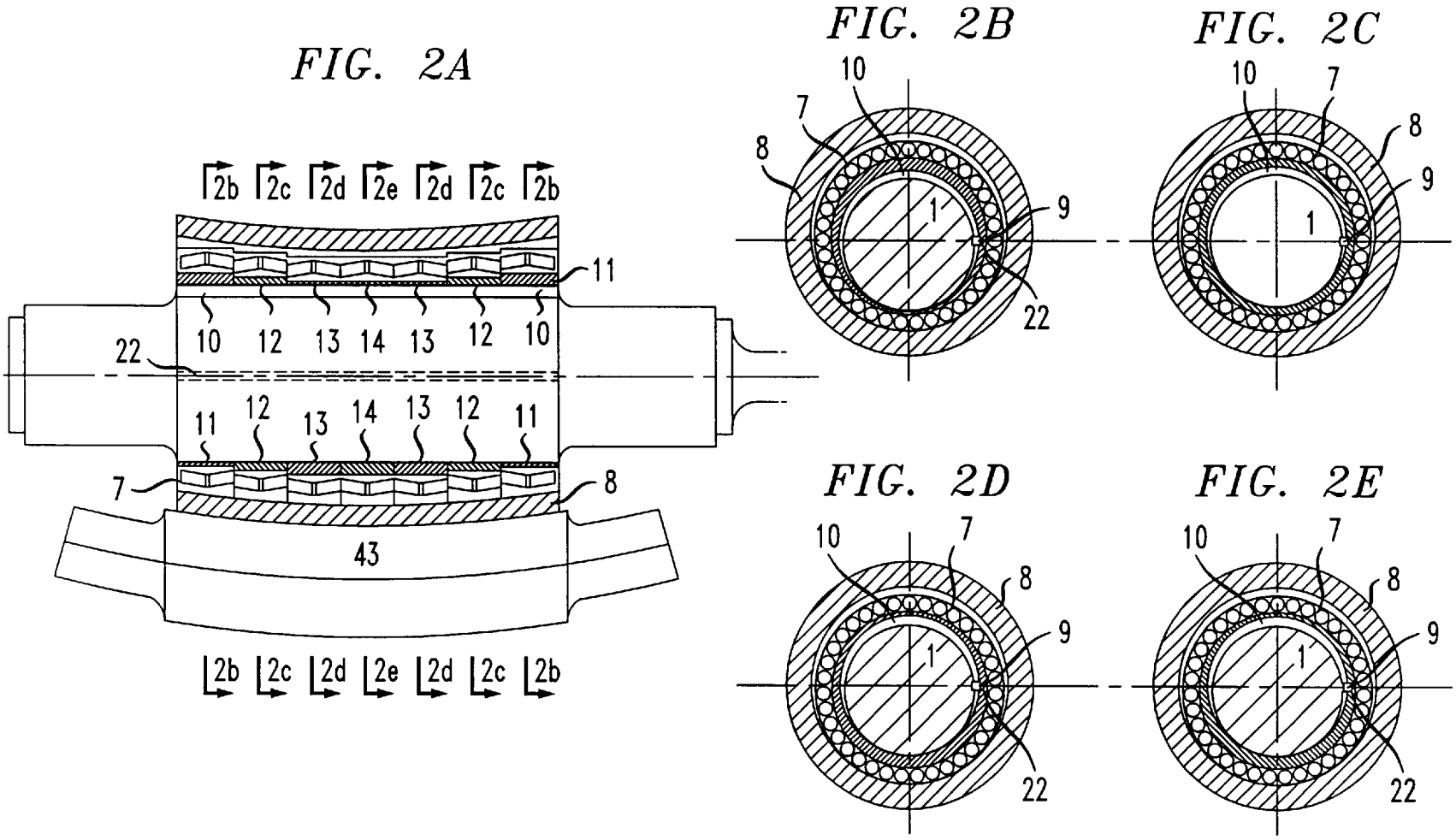
FIGS. 2*a*–2*e* illustrate a configuration of the invention in which the clearance is inside the rings; the sections of FIGS. 2*b*–2*e* are through the sleeve and sets of rings and bearings similar to FIGS. 1*b*–1*e*.

FIG. 2*a* is a view similar to that of FIG. 1*a* but instead of depicting an exaggerated clearance space 6 on the high side of bearings 7 as in FIGS. 1*a*–1*e*, an exaggerated clearance space 10 is shown on the high side of the arbor 1, between arbor 1 and rings 11, 12, 13, and 14

In FIGS. 1 and 2, the clearance spaces 6 and 10 are shown on the high sides of bearings 7 and arbor 1 respectively because in use the clearance spaces are compressed on the lower portion of the assembly. In practice, the clearance spaces permit the relative ease of assembly. In the configuration of FIGS. 1*a*–1*e*, the clearance space 6 permits the ready placement of sleeve 8 over bearings 7; in the configuration of FIGS. 2*a*–2*e*, the clearance space 10 permits ready placement of rings 11, 12, 13 and 14 over arbor 1. In either case, the rings are held in the desired position by key 9 in slot 22.

FIG. 3*a* shows my invention utilizing rings 30, 31, and 32 fixed closely to arbor 1. Bearings 33 are separated from each other by spacers 34 and retained by retainers 38. Each bearing 33 has its own sleeve, in effect, in the form of collar 35. As is the case with the variations of FIGS. 1*a*–1*e* and 2*a*–2*e*, rings 30, 31, and 32 are held in position by key 36 in slot 37. It may be observed from FIG. 3*d* that, if the position of the arbor with the rings, bearings and collars were inverted, i.e. rotated 180°, the crown would be negative; if it were to be rotated 90°, the crown would be neutral. Thus, beginning at a neutral position, one may achieve any regular positive crown profile from minimal to maximum by rotating the arbor within a 90° turn in either direction.

Working rolls 42 and 43 are shown in an exaggerated curve to illustrate the effect of the crown created by the position of rings 30, 31, and 32.

Figure 4:
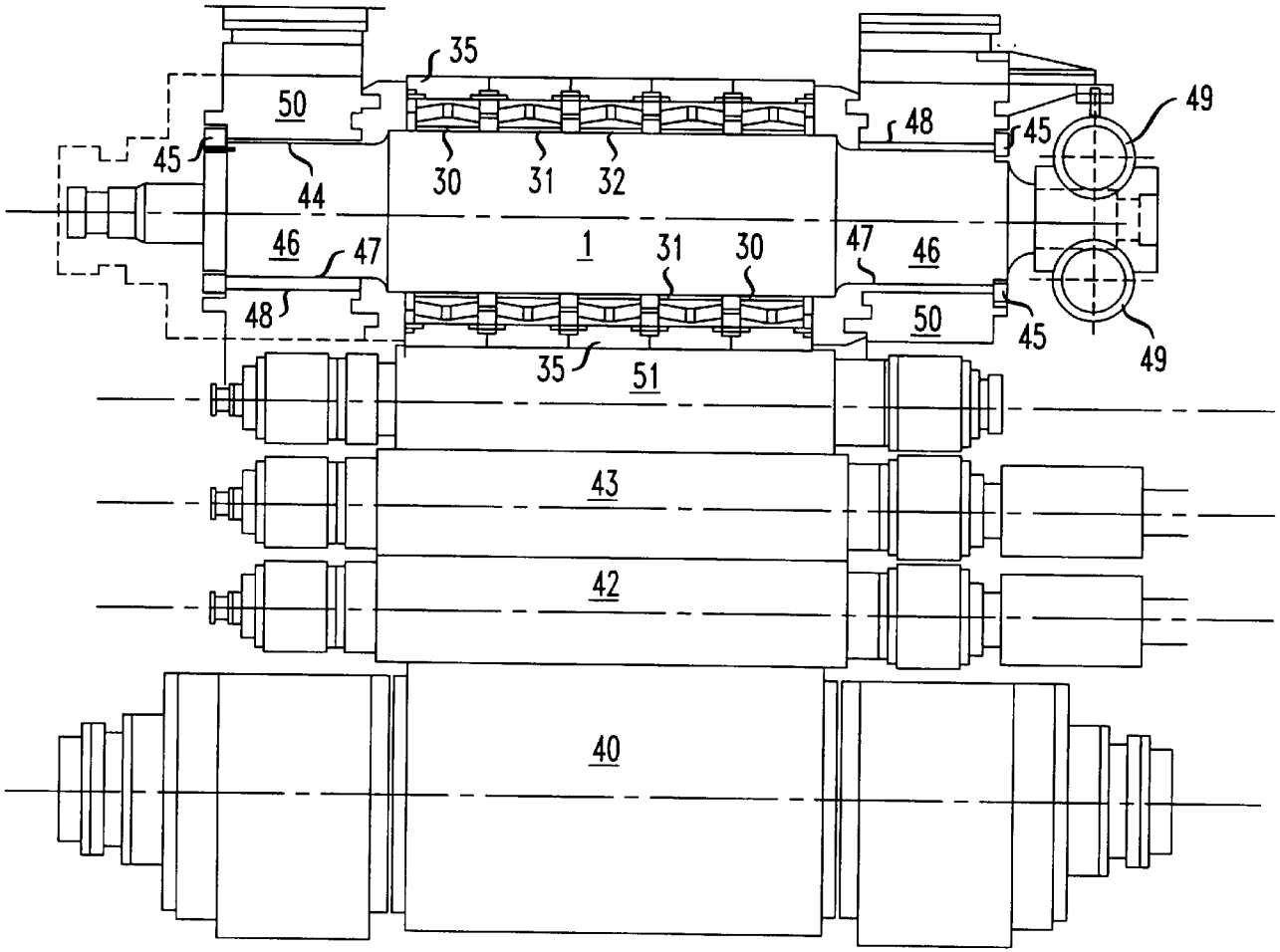
FIG. 4 shows a roll stand for the variation of FIGS. 3*a*–3*f*. It shows the roll intermediate of the back-up roll and the working rolls. In addition, it shows the placement of the arbor-rotating mechanism applicable to all variations of my invention.

FIG. 4 shows the variation of FIG. 3*a* mounted in a roll stand comprising a lower back-up roll 40, two work rolls 42 and 43, the arbor 1, and intermediate roll 51. Arbor 1 has surrounding it the rings 30, 31, and 32, bearings 33, and collars 35 as in FIG. 3*a*. Persons skilled in the art will recognize that lower back-up roll 40 may be replaced by a back-up roll assembly of my invention, i.e. with another arbor 1 surrounded by eccentric rings 30, 31, and 32, bearings 33 and sleeve 35, with a second intermediate roll 51 between the new lower back-up roll 40 and working roll 42. FIG. 4 also illustrates a construction useful for rotating the arbor in response to a control signal which is a function of the crown of the current product, such as may be generated by a shapemeter or other device known in the art. The arbor necks 46 are equipped with steel spacers 47 and outside sealing and thrust rings 45. A bronze or babbit liner 48 inside the chocks 50 provides a bearing surface to permit continuous rotating adjustment of the arbor 1. The rings rotate with the arbor because they are keyed to it. A hydraulic rotary actuator 49 is keyed to the arbor providing constant repositioning of the arbor by rotation to effect the crown adjustment. Crown adjustment may be effected in a similar manner for the variations of FIGS. 1 and 2. Any device that can provide rotation of the arbor may be used instead of a hydraulic rotary actuator, such as a gear drive powered by an electric or hydraulic motor.

Figures 5A, 5B, 5C:
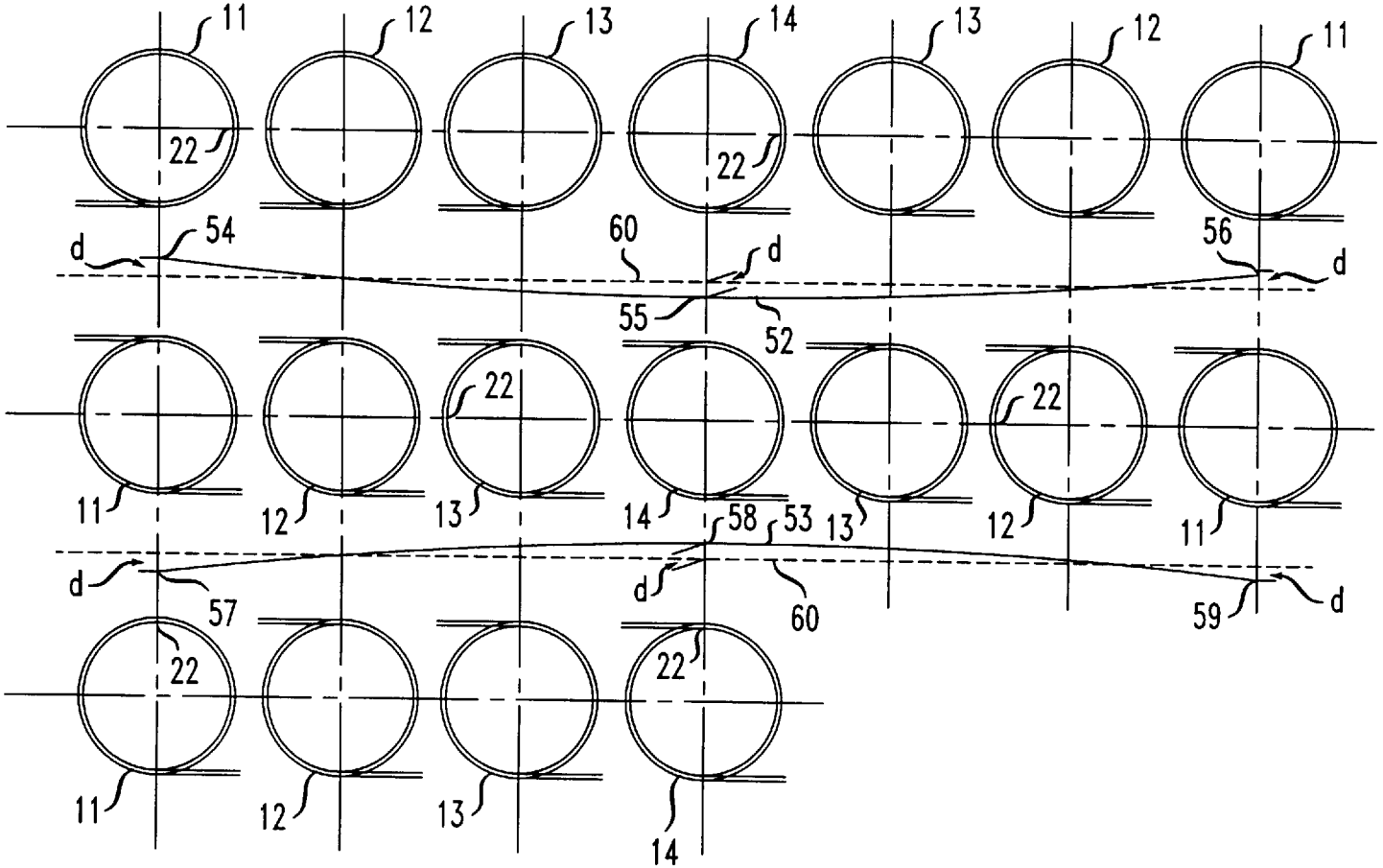
FIGS. 5*a*–5*c* is a series of orientations of seven eccentric rings, showing the crown effect achieved in selected positions.

In FIGS. 5*a*, 5*b*, and 5*c*, the orientations of the eccentric rings 11, 12, 13, and 14 (see FIG. 2) are shown in some detail. In FIG. 5*a*, the rings 11, 12, 13, and 14 are oriented to achieve the "maximum out" effect illustrated by exaggerated arc 52. This arc is determined by selecting points 54, 55, and 56 having a distance d from the straight line 60; the circular arc 52 is part of the circle defined by those three points.

Likewise, when key slot 22 is rotated 180° to arrive at the left side of the rings as depicted in FIG. 5*b*, points 57, 58, and 59 determine the circular arc 53, which represents the (exaggerated for illustration) profile of the "maximum in" position. The thickness of eccentric rings 12 varies from 0.09976 to 1.0024 while that of eccentric rings 13 varies from 0.9844 to 1.0156; eccentric rings 11 and 14 in this preferred configuration vary in thickness from 1.02 to 0.98 (arbitrary units of measure) in order to create the desired crown. Thus the eccentricities of the rings in this particular preferred example are determined by distances between the axes for the internal and external cylindrical surfaces of the rings as follows: ring 12—0.0024; ring 13—0.0156, and rings 11 and 14—0.02.

As may be seen in FIG. 5*c*, the rings 11, 12, 13, and 14 are oriented with the slot 22 at its highest, which means all of the rings have a thickness of 1 at the low point, and the crown profile is therefore straight.

One skilled in the art may realize that an odd number of rings is advantageous, so the center ring can serve as the center of the crown, and the rest of the rings aligned to provide a range of profiles from "maximum out" to "maximum in" within an arbor turn of 180°.

As the surfaces of the rings are nominally parallel to the surface of the arbor, and as this condition tends to exert relatively great force on the corners or working edges of the rings, it may be desired to chamfer them slightly to reduce the stress on the internal surface of the sleeve.

As mentioned above in connection with FIG. 4, my back-up roll assembly may be used in both lower and upper positions in a roll stand, in the configurations of FIGS. 1 and 2 as well as with the segmented sleeve of FIG. 4, although an intermediate roll is not necessary (but could be used) with the unsegmented sleeves of FIGS. 1 and 2.

I claim:

1. A crown control back-up roll assembly for a rolling mill comprising an arbor, a plurality of eccentric rings around said arbor and keyed thereto, at least one sleeve surrounding said rings, and a roller bearing between said sleeve and each of said rings.

2. A crown control back-up roll assembly of claim 1 including means for continuously adjusting, the angular position of said arbor and said eccentric rings through about 180 degrees as a function of current product crown.

3. A crown control back-up roll assembly of claim 1 wherein said eccentric rings are deployed on said arbor to achieve maximum convex crown curvature at a first position and are rotatable with said arbor to achieve a minimum crown curvature at a second position.

4. A crown control back-up roll assembly of claim 3 wherein said maximum and minimum crown curvatures have the shape of substantially circular arcs.

5. A crown control back-up roll assembly comprising a sleeve, an arbor within said sleeve, roller bearings on the internal surface of said sleeve for supporting the rotation of said sleeve, and a plurality of eccentric rings mounted on keyed to said arbor and supporting said roller bearings.

6. A crown control back-up roll assembly of claim 5 having a clearance space between said arbor and said rings.

7. A crown control back-up roll assembly of claim 5 having a clearance space between said bearings and said sleeve.

8. A crown control back-up roll assembly of claim 5 wherein said sleeve has a substantially cylindrical internal surface and a slightly barrel-shaped external surface, and wherein a transverse section of said barrel-shaped external surface taken in the same plane as the axis of said sleeve will exhibit a substantially circular arc based on points at the two ends of said external surface and the central crown point.

9. A crown control back-up roll assembly of claim 5 wherein said eccentric rings are deployed on said arbor to effect positive and negative circular arc crown profiles within an angular range of zero to 180°.

10. A method of controlling crown formation in metal rolling comprising (a) rolling said metal against a working roll having as a back-up roll a sleeve and an arbor within said sleeve, a series of eccentric rings on said arbor, and roller bearings on said eccentric rings for contacting the internal surface of said sleeve, (b) generating a control signal representing the current product crown profile, and (c) continuously adjusting the angular position of said arbor in response to said signal.

11. A method of claim 10 wherein there are seven eccentric rings on said arbor.

12. Method of claim 10 wherein a second working roll has a back-up roll comprising a sleeve and an arbor within said sleeve, a series of eccentric rings on said arbor, and roller bearings on said eccentric rings for contacting the internal surface of said sleeve.

13. Method of claim 10 wherein there is an intermediate roll between said sleeve and said working roll.

14. A crown control back-up roll assembly of claim 1 wherein said roller bearings are chamfered on both sides.

15. A back-up roll assembly for a rolling mill comprising (1) an arbor (2) a plurality of eccentric rings fixed in place on said arbor (3) bearings having outer races and inner races contacting and surrounding said rings (4) a sleeve over the length of said arbor and contacting the outer races of said bearings, said eccentric rings being fixed in place on said arbor by a key, said rings and said bearings providing a contact surface effected through said bearings and said sleeve for contacting a work roll, said eccentric rings being aligned and placed so that said contact surface can be changed gradually by angular adjustment of said arbor through an angular range of 0 to 180°.

16. A back-up roll assembly of claim 15 including a rotator for said arbor, said rotator being continuously responsive to a signal which is a function of deviation of the current product crown from a desired crown.

17. A crown control back-up roll assembly for a rolling mill comprising an arbor, a plurality of eccentric rings thereon, roller bearings around said eccentric rings, and means for continuously adjusting the angular position of said arbor and said eccentric rings through about 180 degrees as a function of current product crown.

18. A roll stand for a rolling mill comprising upper and lower back-up roll assemblies of claim 15 and a pair of work rolls between said back-up roll assemblies.

19. A roll stand of claim 18 including intermediate rolls between said work rolls and said back-up roll assemblies.

* * * * *